US009490553B2

(12) United States Patent
I et al.

(10) Patent No.: US 9,490,553 B2
(45) **Date of Patent: *Nov. 8, 2016**

(54) ROUND TERMINAL FIXATION STRUCTURE

(71) Applicant: Yazaki Corporation, Tokyo (JP)

(72) Inventors: Sunsoku I, Makinohara (JP); Takaaki Kakimi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 15 days.

This patent is subject to a terminal disclaimer.

(21) Appl. No.: 14/267,163

(22) Filed: May 1, 2014

(65) Prior Publication Data

US 2014/0335744 A1 Nov. 13, 2014

(30) Foreign Application Priority Data

May 9, 2013 (JP) ..... 2013-099190

(51) Int. Cl.

| | |
|---|---|
| ***H01R 4/36*** | (2006.01) |
| ***H01R 4/30*** | (2006.01) |
| ***H01R 4/34*** | (2006.01) |
| *H01R 4/18* | (2006.01) |
| *H01R 11/12* | (2006.01) |

(52) U.S. Cl.

CPC ..... *H01R 4/30* (2013.01); *H01R 4/305* (2013.01); *H01R 4/34* (2013.01); *H01R 4/185* (2013.01); *H01R 11/12* (2013.01)

(58) Field of Classification Search

CPC ..... H01R 4/70; H01R 4/30; H01R 4/34
USPC ..... 439/810, 781, 868, 883
See application file for complete search history.

(56) References Cited

U.S. PATENT DOCUMENTS

| | | | | |
|---|---|---|---|---|
| 5,510,960 | A * | 4/1996 | Rosen | H01R 9/2425 361/624 |
| 6,089,930 | A * | 7/2000 | Matsuoka | H01R 4/30 439/883 |
| 6,388,216 | B1 * | 5/2002 | Puhalla | H01R 4/44 200/284 |
| 7,160,157 | B1 * | 1/2007 | Jones, III | H01R 11/11 439/288 |
| 2007/0264865 | A1 * | 11/2007 | Hagikura | H01R 4/30 439/493 |

FOREIGN PATENT DOCUMENTS

JP 2004-127704 A 4/2004

* cited by examiner

*Primary Examiner* — Abdullah Riyami
*Assistant Examiner* — Nader Alhawamdeh
(74) *Attorney, Agent, or Firm* — Locke Lord LLP

(57) ABSTRACT

Provided is a round terminal fixation structure which can easily install a round terminal at a fixation position and prevent assembling failure. The round terminal fixation structure fixes the round terminal connected to an end of an electric wire to a bus bar in an overlapping fashion by a bolt. The round terminal includes a bolt insertion portion having a first through-hole for passing the bolt and a core wire crimp portion crimping a core wire of the electric wire. The bus bar includes a flat plate portion having a second through-hole for passing the bolt and a standing piece extending perpendicularly from the flat plate portion and configured to abut on the core wire crimp portion when bolting the round terminal to prevent rotation of the round terminal. A distal end of the standing piece is slanted towards the flat plate portion with distance from the second through-hole.

1 Claim, 13 Drawing Sheets

ROUND TERMINAL FIXATION STRUCTURE

CROSS REFERENCE TO RELATED APPLICATION

This application is on the basis of Japanese Patent Application No. 2013-099190, the contents of which are hereby incorporated by reference. Also, this application is related to co-pending application: "ROUND TERMINAL FIXATION STRUCTURE" filed even date herewith in the names of Takaaki Kakimi and Hiroaki Yamada which claims priority to Japanese Application No. 2013-099189 filed May 9, 2013, application is assigned to the assignee of the present application.

TECHNICAL FIELD

The present invention relates to a round terminal fixation structure for fixing a round terminal connected to an end of an electric wire to a bus bar in an overlapping fashion using a bolt.

BACKGROUND ART

The round terminal fixation structure mentioned above is used for example in an electrical junction box of an automobile (refer to Patent Literature 1). FIG. 11 is a perspective view showing a portion of an electrical junction box employing a conventional round terminal fixation structure. FIG. 12 illustrates an operation of fixing the round terminal to the bus bar shown in FIG. 11. FIG. 13 is a bottom view of the electrical junction box shown in FIG. 12. FIG. 14 illustrates a problem that arises in the round terminal fixation structure shown in FIG. 11. FIG. 15 is a side view of the round terminal fixation structure shown in FIG. 14.

As shown in FIGS. 11 and 12, a round terminal fixation structure 301 is configured to fix a round terminal 3 (also called a LA terminal) connected to an end of an electric wire 2 to a bus bar 304 provided to an electrical junction box 310 of an automobile in an overlapping fashion using a bolt 5.

In FIGS. 11-13, a reference sign 8 denotes a block made of synthetic resin. The bus bar 304, a nut 7 to which the bolt 5 is threadably mounted and a plurality of components such as a relay and a fuse (not shown) are attached to this block 8. A portion of the bus bar 304 is exposed at a terminal connection portion 80 of the block 8, and the round terminal 3 is placed on this exposed portion. In FIG. 11, an arrow B represents a rotation direction of the bolt 5 during threadably mounting the bolt 5 the nut 7.

The round terminal 3 includes a bolt insertion portion 31 provided with a first through-hole 30 through which the bolt 5 is passed (see FIG. 14), a core wire crimp portion 32 for crimping a core wire 21 of the electric wire 2, and an insulating cover crimp portion 33 for crimping an insulating cover 22 of the electric wire 2.

The bus bar 304 includes a flat plate portion 341 provided with a second through-hole 340 through which the bolt 5 is passed (see FIG. 14), a rotation restriction piece 342 extending perpendicularly from the flat plate portion 341 to restrict the rotation of the round terminal 3 when tightening the bolt 5, and a plurality of connection portions (not shown) electrically connected to the relay or the fuse.

As shown in FIG. 12, for such round terminal fixation structure 301, the round terminal 3 is inserted into the block 8 and placed onto the bus bar 304 at the terminal connection portion 80, and the bolt 5 having a washer 6 is passed through the first through-hole 30, the second through-hole 340 and the nut 7, and then the bolt 5 is rotated in the B direction (see FIG. 11) and threadably mounted on the nut 7, thereby fixing the round terminal 3 on the bus bar 304 and electrically connecting the round terminal 3 with the bus bar 304.

CITATION LIST

Patent Literature

Patent Literature 1: Japan Patent Application Publication No. 2004-127704

SUMMARY OF INVENTION

Problem to be Solved

However, the conventional round terminal fixation structure 301 described above has several problems as explained below.

Firstly, as shown in FIGS. 14 and 15, if the boil 5 is accidentally tightened while the round terminal 3 is located over the rotation restriction piece 342, the round terminal 3 may be fixed in a deformed fashion as shown by a dotted line in FIG. 15. Also, in this case, it is possible that such assembling failure is overlooked, since the bus bar 304 and the round terminal 3 will still conduct with each other in a later continuity check.

Furthermore, the rotation restriction piece 342 needs to have a certain height in order to reliably restrict the rotation of the round terminal 3, and the greater the height of the rotation restriction piece 342 can more reliably restrict the rotation of the round terminal 3. However, as the height of the rotation restriction piece 342 gets greater, a space between a wall surrounding the terminal connection portion 80 of the block 8 and a distal end of the rotation restriction piece 342 (i.e. the space denoted by a reticle portion S in FIG. 13) is decreased, causing a difficulty in inserting the round terminal 3 into this space.

In view of the above-mentioned problem, an object of the present invention is to provide a round terminal fixation structure in which a round terminal can be easily installed at a fixation position and which can prevent an assembling failure.

Solution to Problem

In order to achieve the above-described object, the present invention provides, in a first aspect, a round terminal fixation structure including: a round terminal connected to an end of an electric wire; and a bus bar, the round terminal being configured to be fixed to the bus bar in an overlapping fashion by a bolt, wherein the round terminal includes a bolt insertion portion provided with a first through-hole through which the bolt is passed, and a core wire crimp portion crimping a core wire of the electric wire, wherein the bus bar includes a flat plate portion provided with a second through-hole through which the bolt is passed, and a standing piece extending perpendicularly from the flat plate portion and configured to abut on the core wire crimp portion of the round terminal when bolting the round terminal to prevent a rotation of the round terminal, and wherein a distal end of the standing piece is slanted towards the flat plate portion with distance from the second through-hole.

The present invention provides, in a second aspect, the round terminal fixation structure described above, wherein the bus bar further includes a second standing piece extending perpendicularly from the flat plate portion and configured to position the core wire crimp portion of the round terminal between the standing piece and the second standing piece while the first through-hole is overlapped with the second through-hole, and wherein a distal end of the second standing piece is slanted towards the flat plate portion with distance from the second through-hole.

Advantageous Effects of Invention

According to the invention described in the first aspect, the distal end of the standing piece is slanted towards the flat plate portion with distance from the second through hole. Thus, even if be bolt is accidently tightened while the round terminal is located over the standing piece, the round terminal is moved downward in the direction away from the second through-hole as the bolt is tightened. Thus, the round terminal can be prevented from being fixed in a deformed fashion.

According to the invention described in the second aspect, the bus bar further includes the second standing piece. Thus, the round terminal can be easily installed at the fixation position by positioning the core wire crimp portion between the standing piece and the second standing piece. Furthermore, just like in the case of the standing piece, even if the bolt is accidently tightened While the round terminal is located over the second standing piece, the round terminal is moved downward in the direction away from the second through-hole as the bolt is tightened. Thus, the round terminal can be prevented from being fixed in the deformed fashion.

DESCRIPTION OF EXEMPLARY EMBODIMENTS

First Embodiment

In the following, a round terminal fixation structure according to a first embodiment of the present invention and an electrical junction box employing said round terminal fixation structure are explained with reference to FIGS. 1-6.

Figure 1:
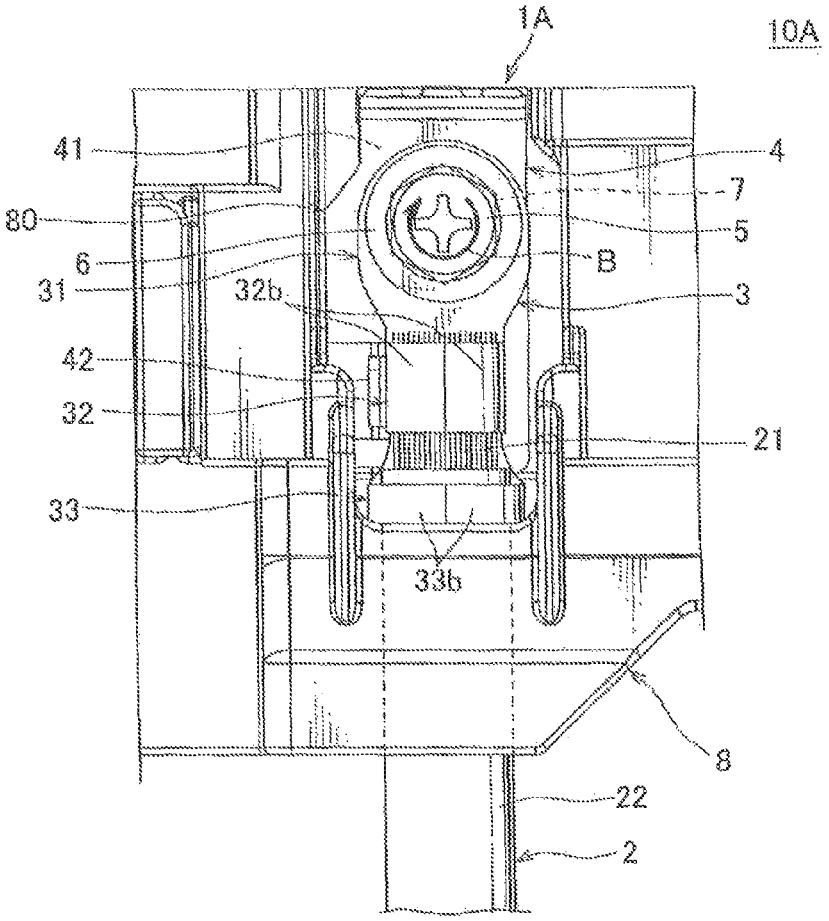
FIG. 1 is a side view of an electrical junction box employing a round terminal fixation structure according to a first embodiment of the present invention.
Figure 2:
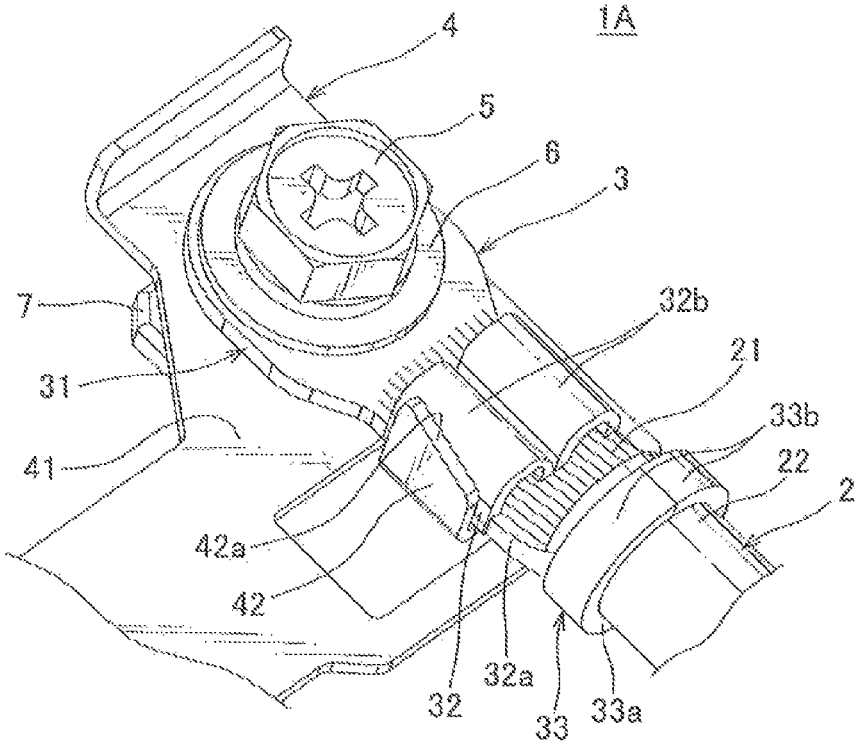
FIG. 2 is a perspective view of the round terminal fixation structure shown in FIG. 1.

A round terminal fixation structure 1A shown in FIGS. 1 and 2 is a structure for fixing a round terminal 3 (also called a LA terminal) connected to an end of an electric wire 2 to a bus bar 4 provided to an electrical junction box 10A of an automobile in an overlapping fashion using a bolt 5.

Figure 4:
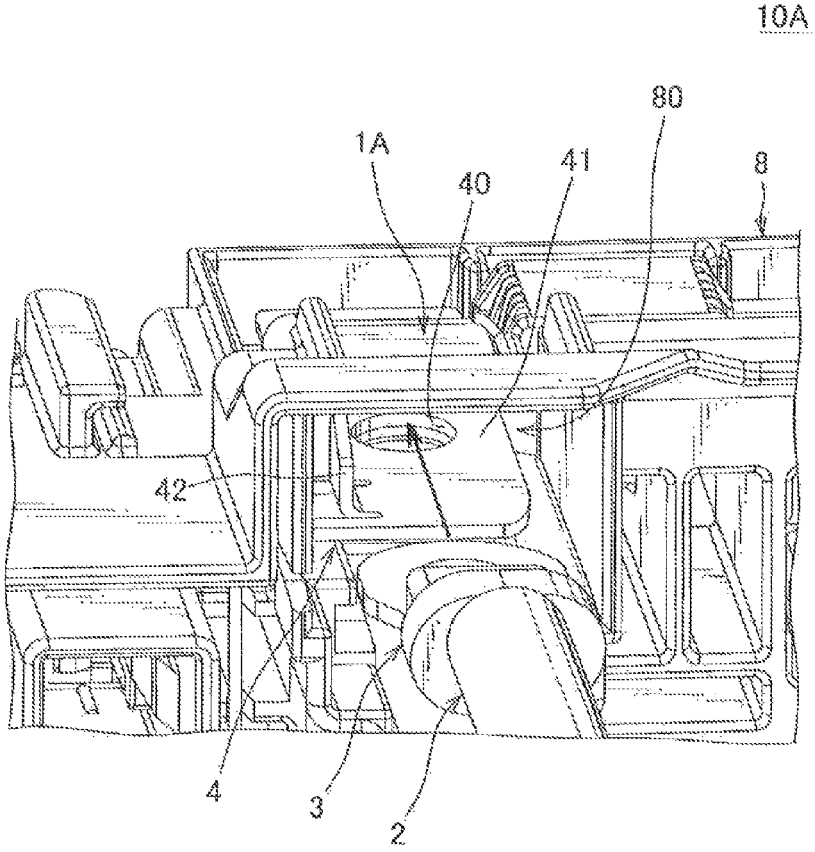
FIG. 4 illustrates an operation of fixing a round terminal to the bus bar shown in FIG. 1.
Figure 5:
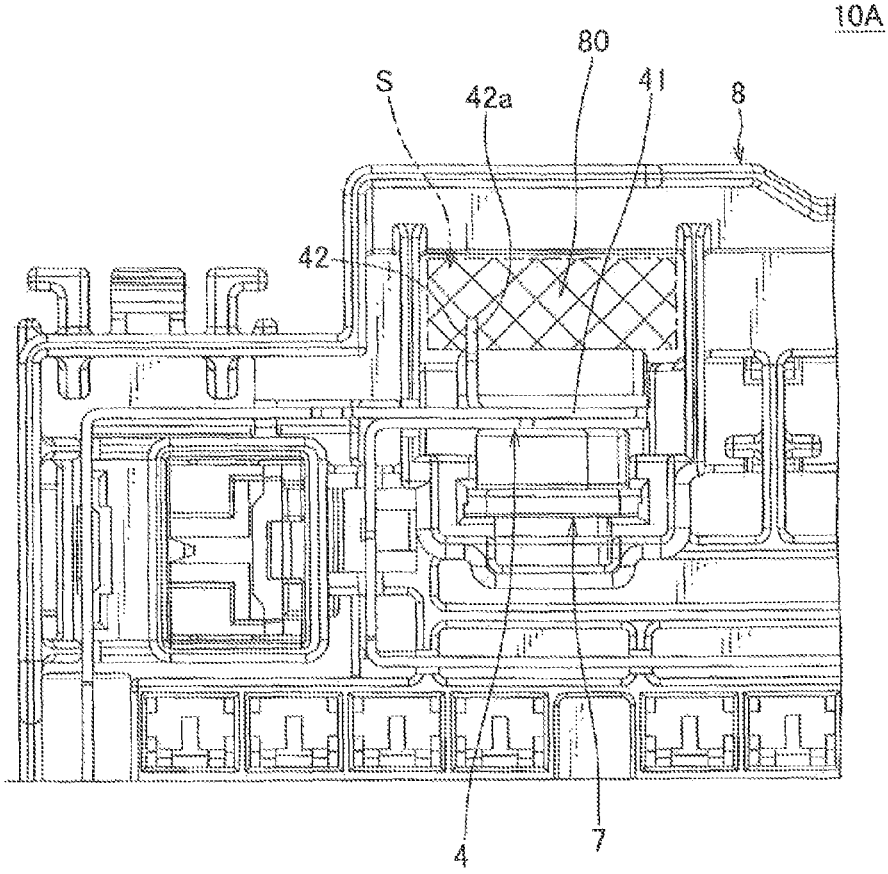
FIG. 5 is a bottom view of the electrical junction box shown in FIG. 4.
Figure 6:
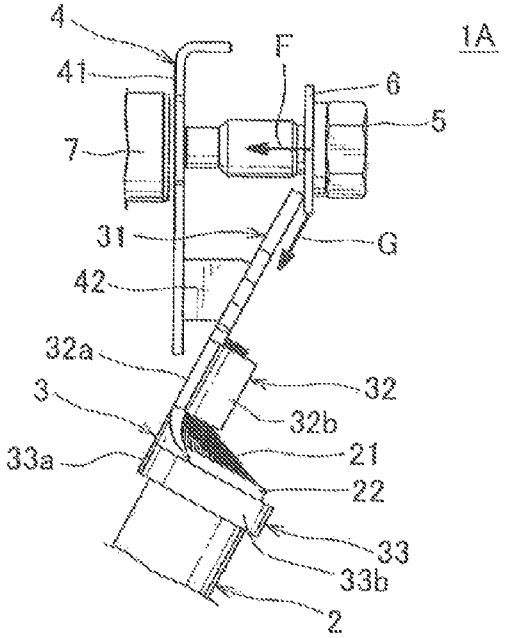
FIG. 6 illustrates function effect of the round terminal fixation structure shown in FIG. 1.

In FIGS. 1, 4 and 5, a reference sign 8 denotes a block made of synthetic resin. The bus bar 4, a nut 7 to which the bolt 5 is threadably mounted and a plurality of components such as a relay and a fuse (not shown) are attached to this block 8. A reference sign 80 denotes a terminal connection portion of the block 8. The bus bar 4 and the round terminal 3 are overlapped to each other at this terminal connection portion 80 and fixed together by the bolt 5 and the nut 7, thereby being electrically connected with each other. In FIG. 1, an arrow B represents a rotation direction of the bolt 5 during threadably mounting the bolt 5 to the nut 7. In addition, the terminal connection portion 80 is surrounded by a tubular wall which is a part of the block 8. This tubular wall is provided with an opening portion for exposing a connection portion of the bus bar 4 and the round terminal 3.

The round terminal 3 may be obtained by pressing a metal plate, for example. As shown in FIG. 2, the round terminal 3 includes a bolt insertion portion 31 provided with a first through-hole through which the bolt 5 is passed, a core wire crimp portion 32 for crimping a core wire 21 of the electric wire 2, and an insulating cover crimp portion 33 for crimping an insulating cover 22 of the electric wire 2. The bolt insertion portion 31 is formed into a plate having a substantially circular shape in a planar view, and the first through-hole is formed at a center of the bolt insertion portion 31. The core wire crimp portion 32 includes a base wall 32*a* continued from the bolt insertion portion 31 and a pair of crimp pieces 32*b* extending upward from both edges of the base wall 32*a*. The insulating cover crimp portion 33 includes a base wall 33*a* continued from the base wall 32*a* and a pair of crimp pieces 33*b* extending upward from both edges of the base wall 33*a*.

Figure 3:
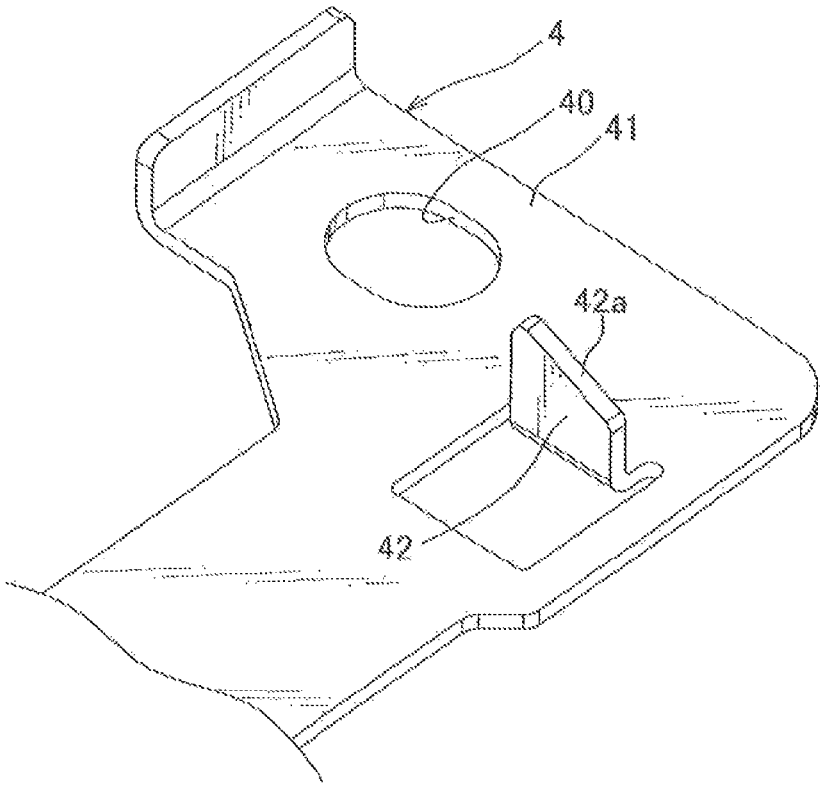
FIG. 3 is a perspective view showing only a bus bar shown in FIG. 2.

The bus bar 4 may be obtained by pressing a metal plate, for example. As shown in FIG. 3, the bus bar 4 includes a flat plate portion 41 provided with a second through-hole 40 through which the bolt 5 is passed, a standing piece 42 extending perpendicularly from the flat plate portion 41 and a plurality of connection portions (not shown) electrically connected to the relay or the fuse mentioned above, the standing piece 42 being configured to abut on the core wire crimp portion 32 during the bolting of the round terminal 3 to restrict the rotation of the round terminal 3, i.e. to prevent the rotation of the round terminal 3. A distal end 42*a* of the standing piece 42 is slanted towards the flat plate portion 41 with distance from the second through-hole 40.

In the round terminal fixation structure 1A mentioned above, the round terminal 3 is fixed to the bus bar 4 in a manner explained below. Firstly, the bus bar 4 and the nut 7 are attached to the block 8 in advance. Then, as shown in FIG. 4, the round terminal 3 is inserted into the block 8, and the first through-hole of the bolt insertion portion 31 is overlapped with the second through-hole 40 of the bus bar 4. That is, the round terminal 3 is installed at the fixation position. Then, the bolt 5 with a washer 6 is passed through the first through-hole of the bolt insertion portion 31, the second through-hole 40 of the fins bar 4 and the nut 7 and tightened, thereby completing the fixing operation of the round terminal 3.

In the above-mentioned procedure, when inserting the round terminal 3 into the block 8, the round terminal 3 can be easily inserted without being hindered by the standing piece 42. That is if the distal end 42*a* of the standing piece 42 is not slanted, the round terminal 3 needs to be inserted through a narrow space between the wall surrounding the terminal connection portion 80 of the block 8 and the non-slanted distal end 42*a* of the standing piece 42, causing a lowering in the workability. However, according to this embodiment, the standing piece 42 is configured such that the distal end 42*a* thereof is slanted towards the flat plate portion 41 with distance from the second thorough hole 40. Thus, the round terminal 3 can be inserted from a wide space formed between the wall surrounding the terminal connection portion 80 of the block 8 and a portion of the distal end 42*a* of the standing piece 42 located most distant from the second through-hole 40 (i.e. a space denoted by a reticle portion S in FIG. 5). Consequently, despite the great height of the standing piece 42, the round terminal 3 can be easily installed at the fixation position without being hindered by the standing piece 42 during the insertion of the round terminal 3 into the block 8. Also, since this standing piece 42 has great height, the standing piece 42 can reliably prevent the rotation of the round terminal 3.

Furthermore, in the round terminal fixation structure 1A, on rare occasions, the round terminal 3 which has once been installed at the fixation position may be displaced before tightening the bolt 5, or the bolt 5 may be tightened while the round terminal 3 is not installed at the fixation position from the beginning. For example, referring to FIG. 6, if the bolt 5 is accidently tightened while the round terminal 3 is located over the standing piece 42, then, as the bolt 5 is tightened (i.e. moved in a F direction) the round terminal 3 is pushed by the washer 6 and moved downward in the direction away from the second through-hole 40 (i.e. a G direction), thus the round terminal 3 is not fixed. Consequently, in the round terminal fixation structure 1A, the round terminal 3 can be prevented from being fixed in a deformed fashion. In addition, since the bus bar 4 and the round terminal 3 do not conduct with each other in a later continuity test, the assembling failure can be detected.

Second Embodiment

In the following, a round terminal fixation structure according to a second embodiment of the present invention and an electrical junction box employing said round terminal fixation structure are explained with reference to FIGS. 7-10, in FIGS. 7-10, the same reference signs are used for the same components as the first embodiment.

Figure 7:
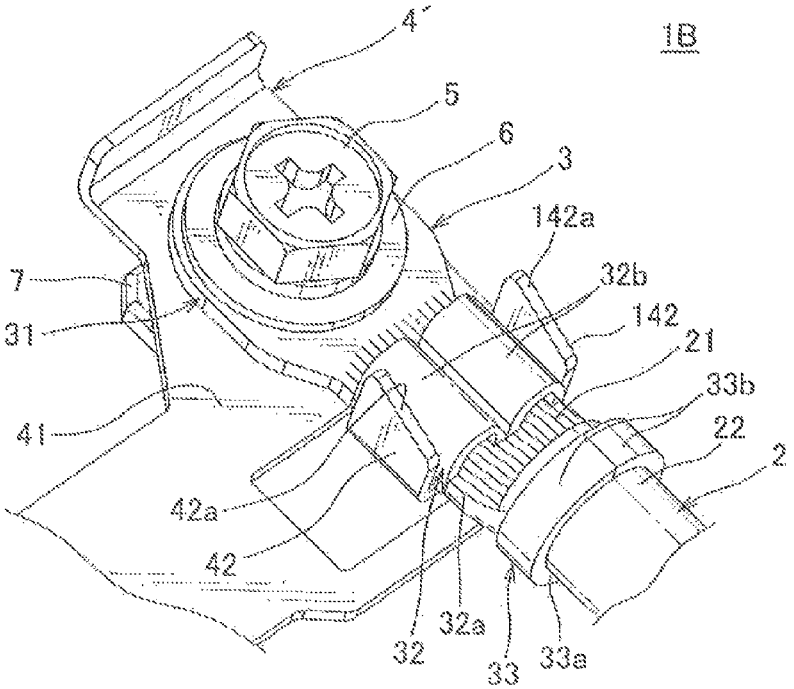
FIG. 7 is a perspective view of a round terminal fixation structure according to a second embodiment of the present invention.

A round terminal fixation structure 1B shown in FIG. 7 is similar to the round terminal fixation structure 1A of the first embodiment, except a bus bar 4' further includes a second standing piece 142.

Figure 8:
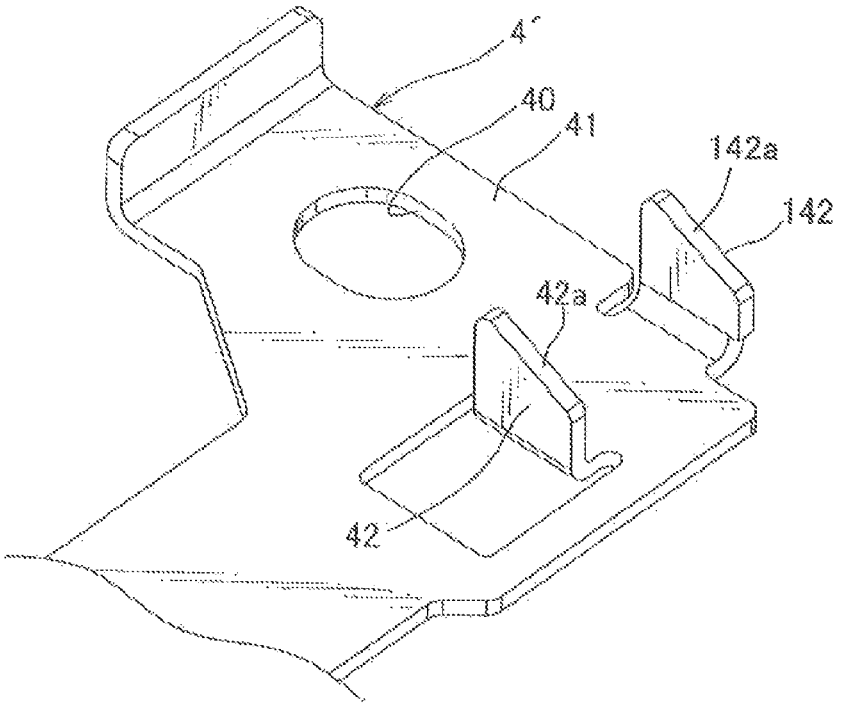
FIG. 8 is a perspective view showing only a bus bar shown in FIG. 7.

As shown in FIG. 8, the second standing piece 142 is extending perpendicularly from a flat plate portion 41 and is configured to position a core wire crimp portion 32 of a round terminal 3 between the second standing piece 142 and a standing piece 42 while a first through-hole of a bolt insertion portion 31 is overlapped with a second through-hole 40 of the bus bar 4'. Furthermore, just like the standing piece 42, a distal end 142*a* of the second standing piece 142 is slanted towards the flat plate portion 41 with distance from the second through-hole 40. Furthermore, for the second standing piece 142, the height from the flat plate portion 41 and the inclination of the distal end 142*a* are the same as the standing piece 42. That is, the standing piece 42 and the second standing piece 142 have the same shape.

For this round terminal fixation structure 1B, when fixing the round terminal 3 to the bus bar 4', the core wire crimp portion 32 is positioned between the standing piece 42 and the second standing piece 142, and the first through-hole of the bolt insertion portion 31 can be overlapped with the second through-hole 40 of the bus bar 4', thus the round terminal 3 can be easily installed at the fixation position.

Figure 9:
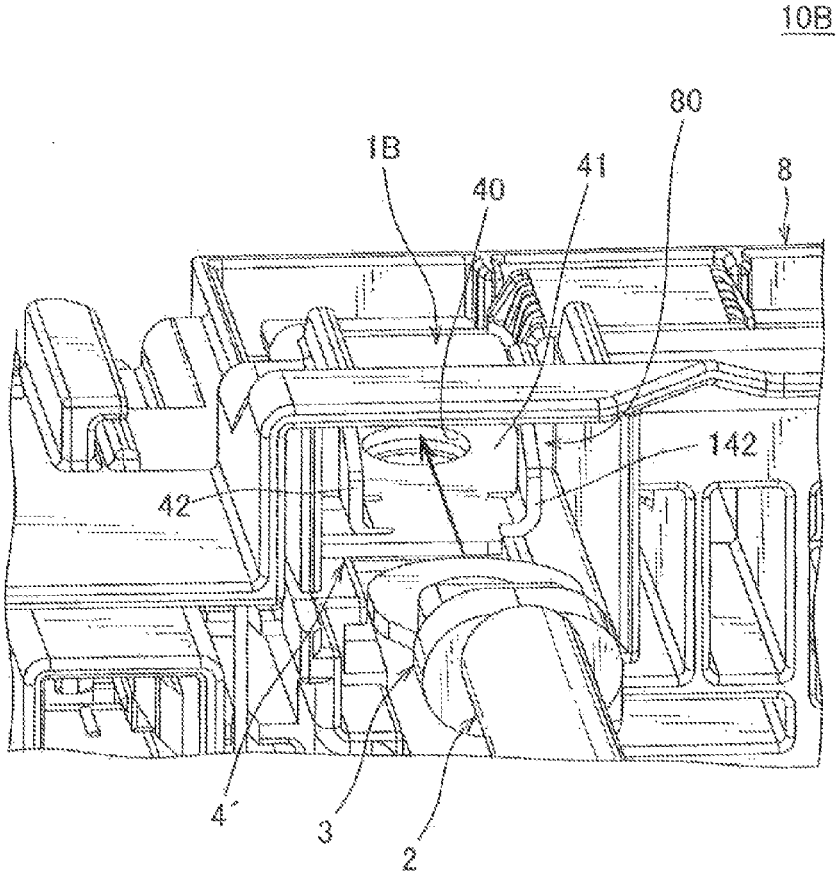
FIG. 9 illustrates an operation of fixing a round terminal to the bus bar in an electrical junction box employing the round terminal fixation structure shown in FIG. 7.
Figure 10:
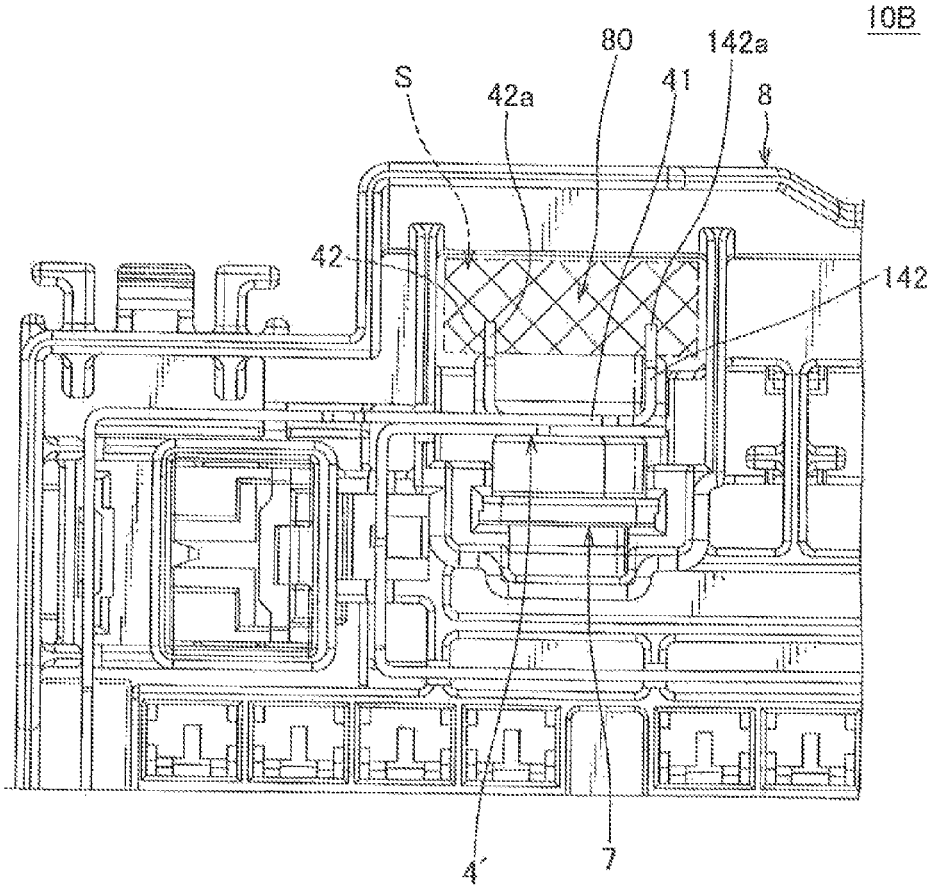
FIG. 10 is a bottom view of the electrical junction box shown in FIG. 9.
Figure 11:
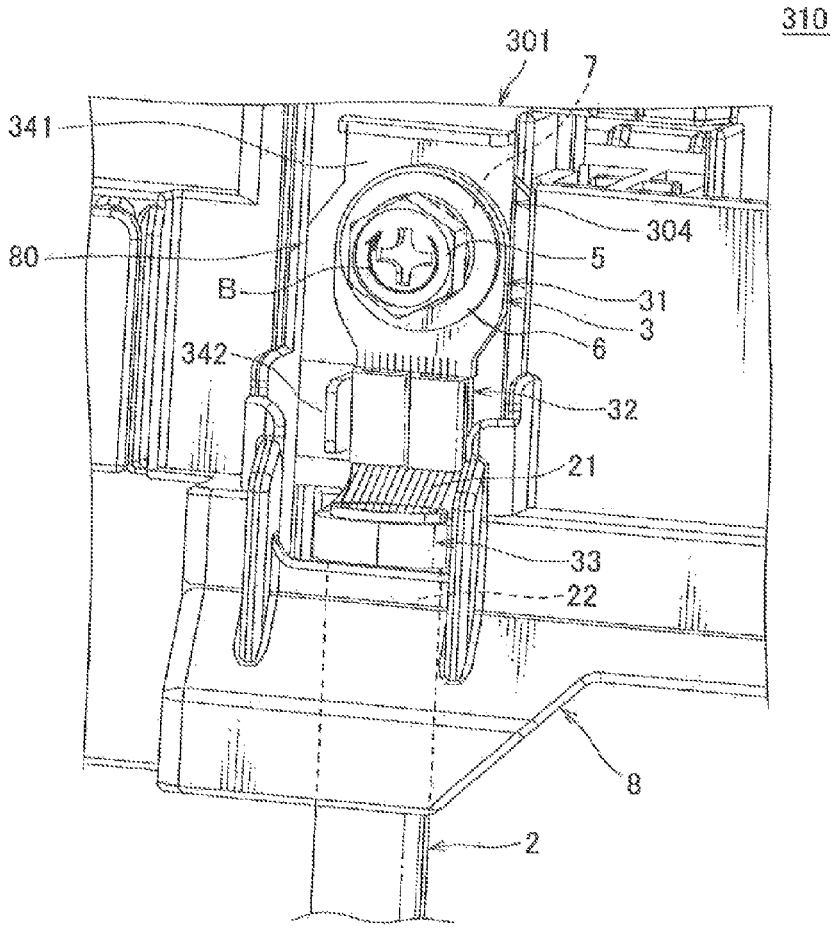
FIG. 11 PRIOR ART
FIG. 11 is a perspective view showing a portion of an electrical junction box employing a conventional round terminal fixation structure.
Figure 12:
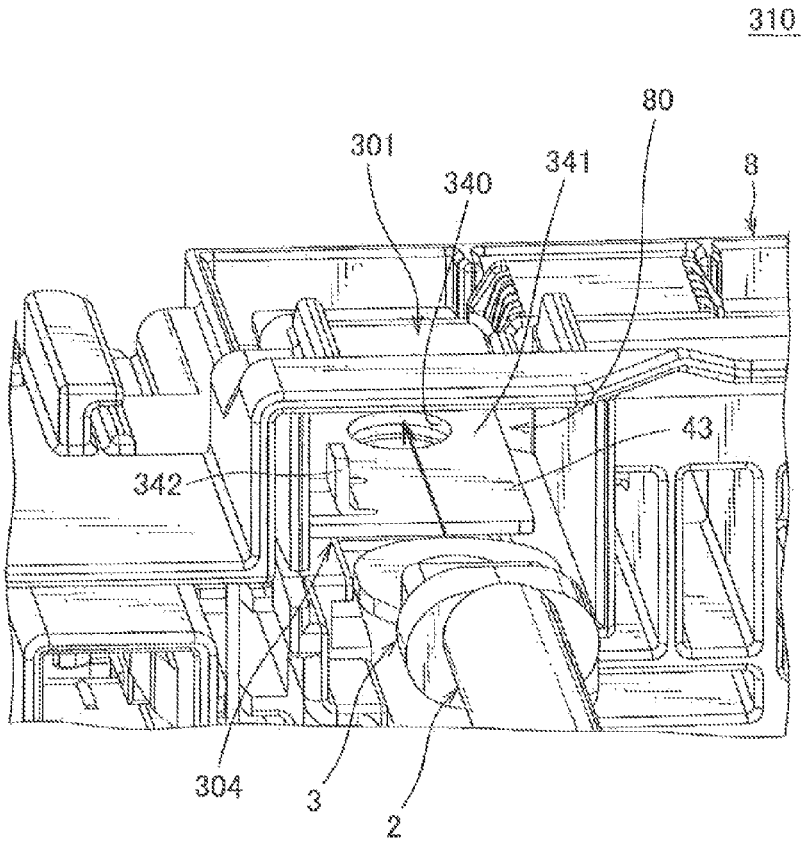
FIG. 12 PRIOR ART
FIG. 12 illustrates an operation of fixing a round terminal to a bus bar shown in FIG. 11.
Figure 13:
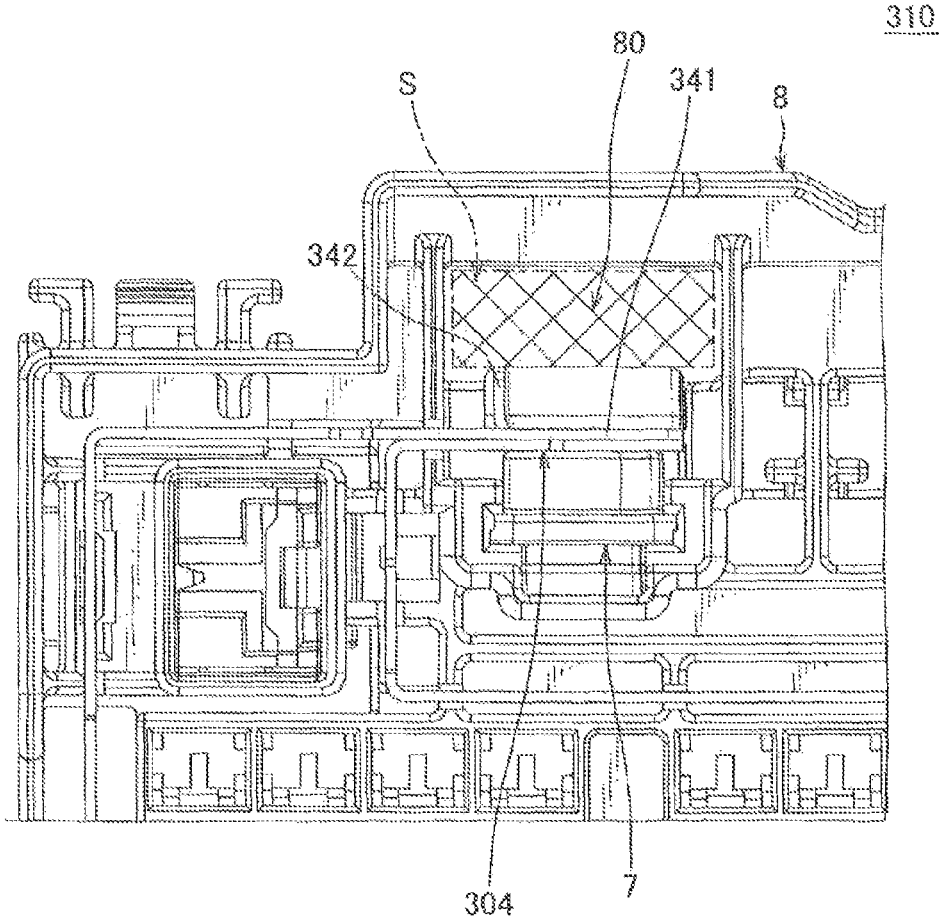
FIG. 13 PRIOR ART
FIG. 13 is a bottom view of the electrical junction box shown in FIG. 12.
Figure 14:
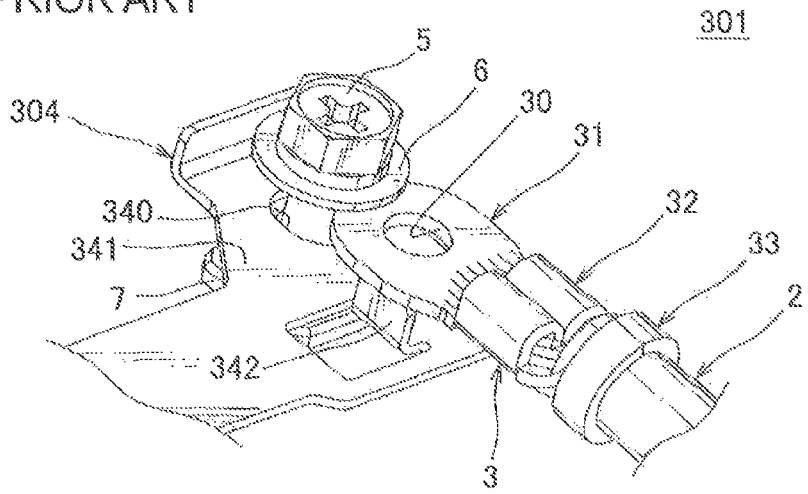
FIG. 14 PRIOR ART
FIG. 14 illustrates a problem which may arise in the round terminal, fixation structure shown in FIG. 11.
Figure 15:
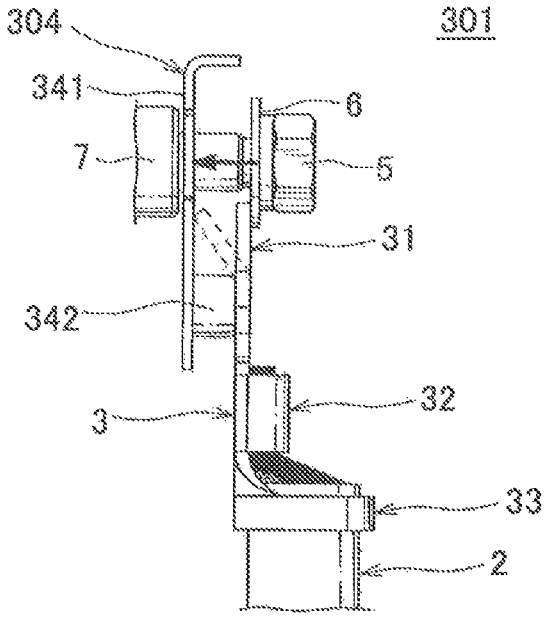
FIG. 15 PRIOR ART
FIG. 15 is a side view of the round terminal fixation structure shown in FIG. 14.

Furthermore, referring to FIG. 9, as in the case of the first embodiment, when inserting the round terminal 3 into the block 8, the round terminal 3 can be easily inserted without being hindered by the standing piece 42 and the second standing piece 142. That is, since the distal ends 42*a*, 142*a* of the standing piece 42 and the second standing piece 142 are slanted towards the flat plate portion 41 with distance from the second through-hole 40, the round terminal 3 can be inserted front a wide space formed between the wall surrounding the terminal connection portion 80 of the block 8 and portions of the distal ends 42*a*, 142*a* of the standing piece 42 and the second standing piece 142 located most distant from the second through-hole 40 (i.e. a space denoted by a reticle portion S in FIG. 10).

Furthermore, in the round terminal fixation structure 1B, on rare occasions, the round terminal 3 which has once been installed at the fixation position may be displaced before tightening the bolt 5, or the bolt 5 may be tightened while the round terminal 3 is not installed at the fixation position from the beginning. For example, if the bolt 5 is accidently tightened while the round terminal 3 is located over the standing piece 42 or the second standing piece 142, then, as in the case of FIG. 6, as the bolt 5 is tightened the round terminal 3 is pushed by the washer 6 and moved downward in the direction away from the second through-hole 40, thus the round terminal 3 is not fixed. Consequently, in the round terminal fixation structure 1B, the round terminal 3 can be prevented from being fixed in a deformed fashion. In addition, since the bus bar 4' and the round terminal 3 do not conduct with each other in a later continuity test, the assembling failure can be detected.

The embodiments described above are only representative embodiments, and the present invention is not limited to these. That is, the present invention can be modified and implemented in various ways without departing from the gist of the present invention.

REFERENCE SIGN LIST

1A, 1B round terminal fixation structure
2 electric wire
3 round terminal
4, 4' bus bar
5 bolt
31 bolt insertion portion
32 core wire crimp portion
40 second through-hole
41 flat plate portion
42 standing piece

The invention claimed is:

1. A round terminal fixation structure comprising:

a round terminal connected to an end of an electric wire; and a bus bar, the round terminal being configured to be fixed to the bus bar in an overlapping fashion by a bolt, wherein the round terminal includes a bolt insertion portion provided with a first through-hole through which the bolt is passed, and a core wire crimp portion crimping a core wire of the electric wire, wherein the bus bar includes a flat plate portion provided with a second through-hole through which the bolt is passed, and a single standing piece extending perpendicularly from the flat plate portion and configured to abut on the core wire crimp portion of the round terminal when bolting the round terminal to prevent a rotation of the round terminal, wherein the single standing piece is formed into a quadrangular shape defined by four sides, said four sides including a first side and a second side opposite to the first side, the first side being adjacent to and parallel to the flat plate portion, and wherein among the four sides defining said quadrangular shape of said single standing piece, the second side is entirely slanted towards the flat plate portion with distance from the second through-hole.

* * * * *